US007726346B2

(12) United States Patent
Doble et al.

(10) Patent No.: US 7,726,346 B2
(45) Date of Patent: Jun. 1, 2010

(54) OUTER TUBULAR REINFORCEMENT MEMBER

(76) Inventors: William C. Doble, 110 Towers Rd., Essex Junction, VT (US) 05452; David J. Dodge, 44 Goldenrod La., Williston, VT (US) 05495

( * ) Notice: Subject to any disclaimer, the term of this patent is extended or adjusted under 35 U.S.C. 154(b) by 1209 days.

(21) Appl. No.: 11/294,273

(22) Filed: Dec. 5, 2005

(65) Prior Publication Data

US 2006/0122013 A1 Jun. 8, 2006

Related U.S. Application Data

(63) Continuation-in-part of application No. 10/351,307, filed on Jan. 27, 2003, now Pat. No. 7,140,398.

(51) Int. Cl.
*F16L 9/00* (2006.01)

(52) U.S. Cl. ..... 138/177; 138/172; 138/174; 473/316; 473/323

(58) Field of Classification Search ..... 138/177, 138/178, 118, 172, 174; 473/323, 316
See application file for complete search history.

(56) References Cited

U.S. PATENT DOCUMENTS

| | | | | | |
|---|---|---|---|---|---|
| 3,300,226 | A * | 1/1967 | Reed, Jr. | ..... | 280/602 |
| 3,461,593 | A * | 8/1969 | Martuch et al. | ..... | 43/18.5 |
| 3,833,219 | A * | 9/1974 | Dean | ..... | 473/523 |
| 4,105,205 | A * | 8/1978 | Theodores et al. | ..... | 473/523 |
| 4,221,400 | A * | 9/1980 | Powers | ..... | 280/602 |
| 4,358,113 | A * | 11/1982 | McKinnon et al. | ..... | 473/561 |
| 4,592,567 | A * | 6/1986 | Sartor | ..... | 280/602 |
| 5,381,782 | A * | 1/1995 | DeLaRama et al. | ..... | 600/149 |
| 5,409,216 | A * | 4/1995 | Brown | ..... | 473/552 |
| 5,879,250 | A * | 3/1999 | Tahtinen et al. | ..... | 473/561 |
| 6,113,508 | A * | 9/2000 | Locarno et al. | ..... | 473/516 |
| 6,257,997 | B1 * | 7/2001 | Doble et al. | ..... | 473/516 |
| 6,520,867 | B1 * | 2/2003 | Miura et al. | ..... | 473/316 |
| 2005/0079925 | A1 * | 4/2005 | Cheng et al. | ..... | 473/316 |

* cited by examiner

*Primary Examiner*—Patrick F Brinson

(57) ABSTRACT

A tubular structural member that provides adjustable directional resistance to a device. When orientated in a certain manner with respect to the direction of use, the tubular structural member will provide a different stiffness to the device it is affixed. The tubular structural member may be integrated with these devices so that these devices can have adjustable resistance and stiffness.

7 Claims, 9 Drawing Sheets

OUTER TUBULAR REINFORCEMENT MEMBER

This application is a continuation in part from application Ser. No. 10/351,307, filed Jan. 27, 2003 now U.S. Pat. No. 7,140,398.

BACKGROUND OF THE INVENTION

1. Field of the Invention

The present invention relates to devices and methods for constructing tubular structural members that allow for variable resistance and stiffness. When the tubular structural member is added to various devices and structures, the tubular structural member gives those devices and structures the ability to change or modify their stiffness or flexing resistance. The tubular structural member is placed over a part of the device along the longitudinal direction over which the stiffness is desired to be changed. The present invention can be used with sports equipment where the user may find it desirable to adjust or change the stiffness of the device, such as hockey sticks, lacrosse sticks, field hockey sticks, bats (for baseball, softball or cricket), golf clubs, fishing rods, skis, snowboards, pole vaulting poles, polo mallets, footwear, masts, scuba fins, bicycles, weightlifting devices, oars and other devices and structures where it may be desirable to change its stiffness. The invention also relates to methods of manufacturing these devices so that the desired stiffness may be set at the time of manufacture.

2. Description of Related Art application Ser. No. 10/351,307 related to tubular structural members that were inserted into cavities in devices in order to change the stiffness and flexural resistance of that device.

Adjustable sports equipment is known from U.S. Pat. Nos. 6,113,508 and 6,257,997 B1 U.S. that have a cavity in which a stiffening rod is inserted. The use of a stiffening rod, called a structural member, is taught into these references. The cross-section of the structural member can vary along its length with respect to its cross-sectional moment of inertia or plane of flexural resistance. Stiffness then becomes a function of the desired stiffness characteristic of the material or materials at that location and the arrangement of those materials. The present application incorporates disclosure of U.S. Pat. Nos. 6,113,508 and 6,257,997 B1, by reference.

In recent years, sports equipment manufacturers have increasingly turned to different kinds of materials to enhance their sporting equipment. In so doing, entire lines of sports equipment have been developed whose stiffness or flexibility characteristics are but a shade different from each other. Such a shade of difference, however, may be enough to give the individual equipment user an edge over the competition or enhance sports performance.

The user may choose a particular piece of sports equipment having a desired stiffness or flexibility characteristic and, during play, switch to a different piece of sports equipment that is slightly more flexible or stiffer to suit changing playing conditions or to help compensate for weariness or fatigue. Such switching, of course, is subject to availability of different pieces of sports equipment from which to choose.

That is, subtle changes in the stiffness or flexibility characteristics of sports equipment may not be available between different pieces of sports equipment, because the characteristics have been fixed by the manufacturer from the choice of materials, design, etc. Further, the user must have the different pieces of sports equipment nearby during play or they are essentially unavailable to the user.

Golf club shafts may be formed of graphite, wood, titanium, glass fiber or various types of composites or metal alloys. Each varies to some degree with respect to stiffness and flexibility. However, golfers generally carry onto the golf course only a predetermined number of golf club. Varying the stiffness or flexibility of the golf club shaft is not possible, unless the golfer brings another set of clubs of a different construction. Even in that case, however, the selection is still somewhat limited.

U.S. Pat. No. 6,113,508 reveals the use of a stiffening rod in cavities of a golf club shaft to permit the user to adjust the stiffness of the golf club shaft. U.S. Pat. No. 6,257,997 reveals the use of a rotating flexure resistance spine in cavities of a golf club shaft to permit the user to adjust the stiffness of the golf club shaft.

BRIEF DESCRIPTION OF THE INVENTION

The present invention relates to devices and methods for constructing tubular structural members that allow for variable resistance in relation to a plane. When added to various devices and structures, the tubular structural member gives those devices and structures the ability to change or modify their stiffness or flexing resistance. The tubular structural member is placed over a part of the device along the longitudinal direction over which the stiffness is desired to be affected.

The tubular structural member is stiffer in one plane than another. Thus, the tubular structural member can provide a directional stiffness as reinforcement for certain devices and structures. The tubular structural member reinforces these devices by being placed over the core of the device or a supporting member. The tubular structural member of the present invention has little tendency to deflect back to a position of lesser resistance when flexed. Since the tubular structural member is torsionaly stiff relative to its longitudinal stiffness, it is torsionaly stable enough to resist movement when flexed if anchored at only one point.

The tubular structural member may be fixed in a particular orientation at the time of manufacture or later, allowing the flexural resistance of the device to be decided without changing the type or quantity of materials used. Other embodiments will allow for changes in device stiffness when desired by the user.

BRIEF DESCRIPTION OF THE DRAWINGS

FIG. 3 depicts the effect of rotating the tubular structural member upon the device it is used with.

DETAILED DESCRIPTION OF THE INVENTION

The present invention relates to a tubular structural member that has a flexural resistance greater in one direction than in another. The tubular structural member may be shaped or constructed of materials in order to achieve this effect. The tubular structural member of the present invention has little tendency to deflect back to a position of lesser resistance when flexed. The tubular structural member is used to change, or give the ability to change, the stiffness or bending resistance of a device. The tubular structural member is placed over the core or center of the device. The tubular structural member may be fixed in a particular orientation at the time of manufacture or later, during use, allowing the flexural resistance of the device to be decided without changing the type or quantity of materials used.

The present invention can be used where flexural stiffness in one direction is important to the use of the device or structure. In particular, sports equipment can benefit from the directional stiffness provided by the present invention. One embodiment employs the tubular structural member in sports equipment having a shaft where flex along the length of the shaft is important. Sports equipment of this type can include golf clubs, hockey sticks, field hockey sticks, lacrosse sticks, bats, oars, masts, fishing rods, pole vaulting poles, and polo mallets. Other embodiments can employ the tubular structural member in weightlifting equipment. For example, the tubular structural member can be employed in exercise equipment that provides weight-like resistance to the user.

The present invention also includes the methods for manufacturing the tubular structural member. The tubular structural member may be affixed in a permanent orientation to its device. This method of manufacture allows production of devices with different flexural properties while using the same raw materials. Methods for creating the present invention can also allow for last minute production and design changes, allowing for different orders and changes by the customer. Certain embodiments may allow for the ability of a user to change position as desired. The device will have means to change the orientation then lock the tubular structural member in place again. The benefit is that changing of the orientation of the tubular structural member in the device or structure, the stiffness of the device or structure will be affected.

The tubular structural member can also be tapered from one end to the other, and can be step-tapered so that its shape fits the requirements of the device. Thus, the tubular structural member will be placed over an internal member with an outer diameter that substantially matches the inner diameter of the tubular structural member along its length. The match-up of these diameters occurs whether they are straight or tapered. The tubular structural member can be free to rotate or fixed in a desired orientation.

Figure 1:
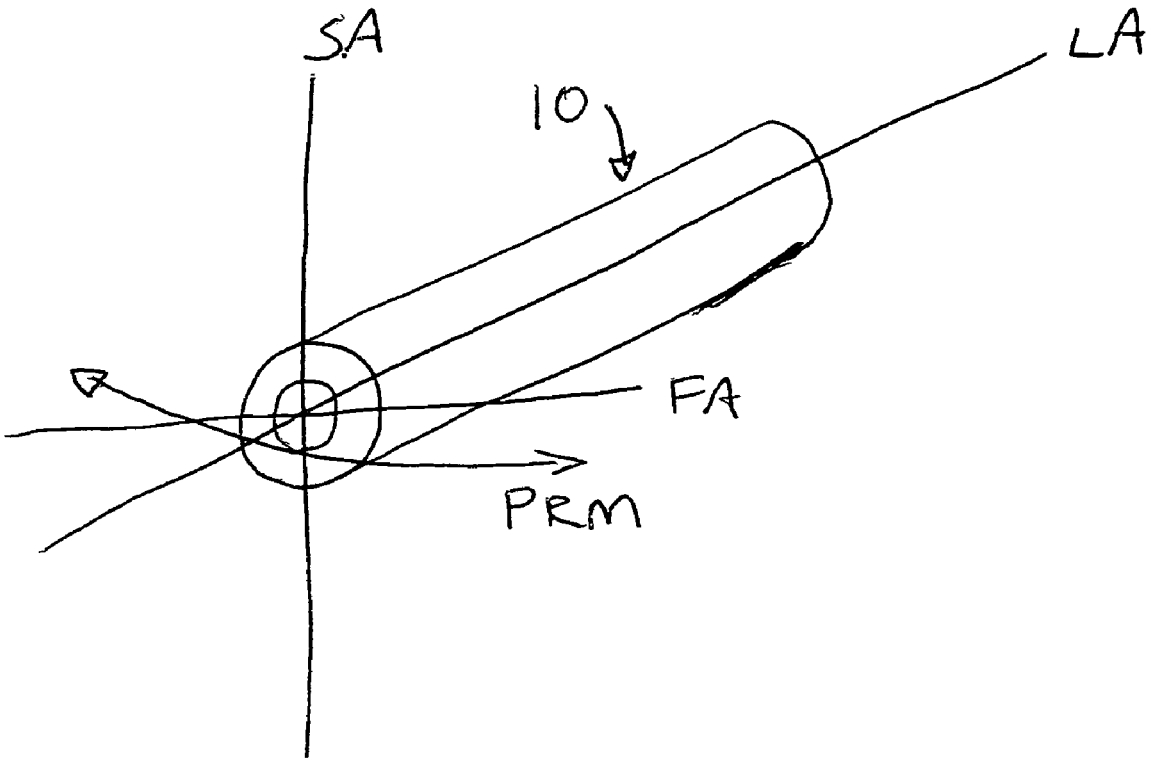
FIG. 1 depicts the axes of the tubular structural member.
Figure 2:
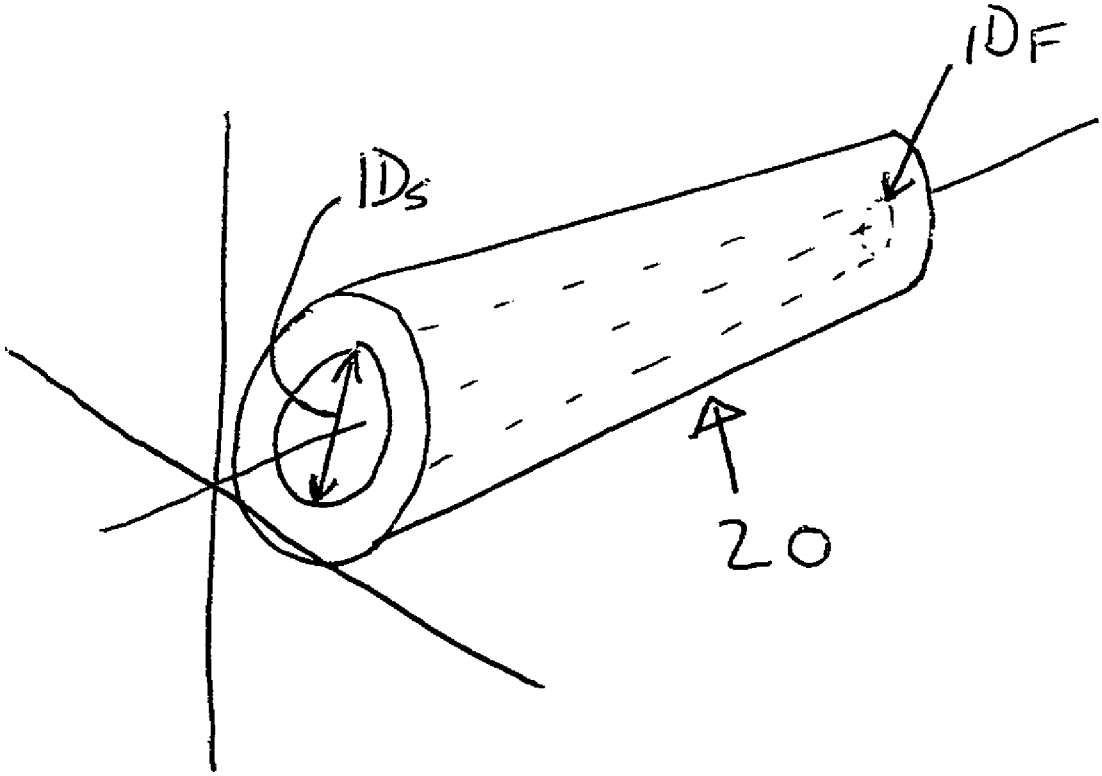
FIG. 2 depicts a tapered tubular structural member.

FIG. 2 depicts a tapered tubular structural member 20. The tapered tubular structural member has an inner diameter that changes over the length of the tube. The diameter is greatest at one end IDs and smallest at the other IDf. FIG. 1 shows the tubular structural member 10 with a constant inner diameter ID. When mated with a device, the outer diameter of the reinforcing area should match the inner diameter of the tubular structural member to ensure good contact and reduced movement.

Certain embodiments can allow for stiffness changes to vary along the appropriate dimension of the sports device by varying the length and spacing of cut-out machined areas on the tubular member or by varying the amount of material, the thickness or otherwise affecting the local stiffness of the tubular member. Other embodiments can employ a similar method where the flexural variations occur along more than one axes. Other methods of construction or manufacture can employ arranging multiple tubular structural members in an arrangement so as to allow the sports equipment to have adjustable flexural resistance in more than one dimension, for example, structures and devices that do not necessarily operate in a unidirectional flexural manner, such as a mast for a sailboat.

The tubular structural member employs directional stiffness. FIG. 1 shows the flexural axis FA on with the plane of the tubular structural member 10 that has the least flexural resistance. The Stiff Axis SA will occur on the plane with the highest flexural resistance. The tubular structural member will prefer to travel about the FA, as shown by the preferred range of motion PRM. However, the tubular structural member can still flex across the stiff axis. The tubular structural member will preferably flex about the flexural axis because that is the direction in which resistance to bending is least. However, by mating the tubular structural member to the desired device, the orientation of the tubular structural member will provide resistance of a level between those provided by the stiff axis and the flexural axis. The level of force provided will depend on that orientation.

Figure 4:
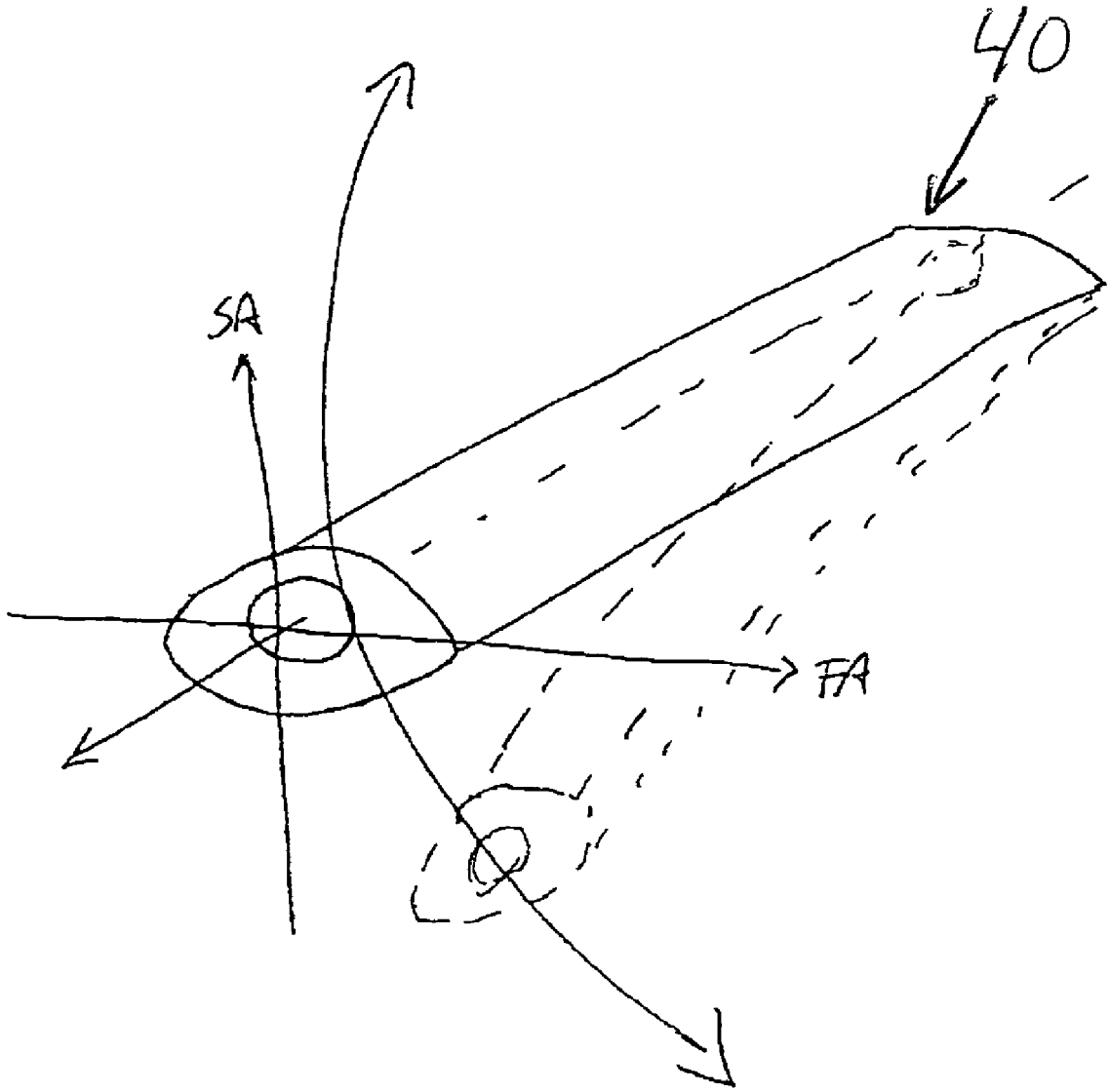
FIG. 4 depicts the axes of motion of a shaped tubular structural member.

As illustrated in FIG. 4, the shaped tubular structural member 40 has a flexural motion (FM). FIG. 4 shows a shaped tubular structural member 40 that creates a stiff axis and a flexural axis because of its shape. Thus, the tubular structural member tends to bend about its flexural axis. The structure is elongated, creating a stiff axis.

The tubular structural member has an internal cavity where it joins the device to which it will be attached (the device will provide a member to be placed in that cavity). For certain embodiments, the tubular structural member will be placed over the length of the body of the device. Other embodiments will involve a device having a reinforcement area.

Figure 3:
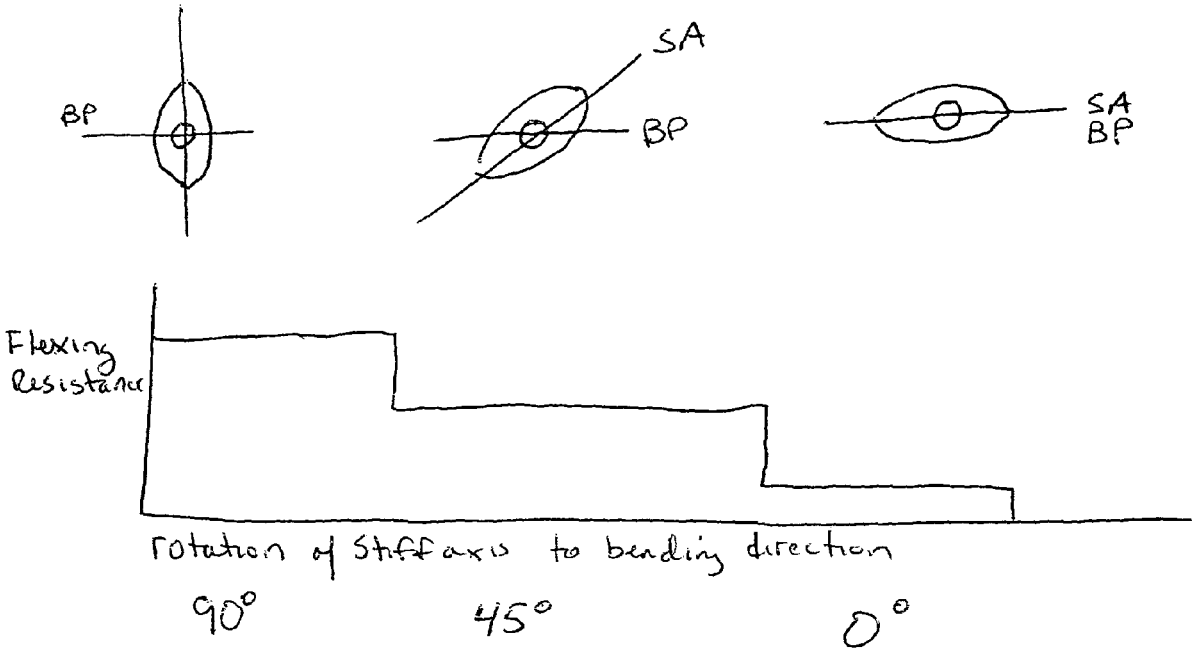

When the tubular structural member reinforces a device, it can be used to change the relative resistance of that device. By changing the radial orientation of the tubular structural member with respect to a device, the overall stiffness of a device changes. Some devices have a particular bending plane or direction dictated by their use. For example, a golf club shaft's stiffness is most important in along the plane of the golf club face. Thus, if the flexing resistance of a golf club shaft were to be changed, the stiff axis of the tubular structural member would be rotated with respect to that bending plane. FIG. 3 depicts the flex resistance greatest when the stiff axis (SA) of the tubular structural member is at 90 degrees to that bending plane (BP). When the tubular structural member is a 0 degrees, parallel to the flexural axis, bending about that axis is easiest. Accordingly, depending on the radial orientation of the tubular structural member relative to a force to be resisted, the tubular structural member will resist more or less.

The resistance of the tubular structural member can be expressed by the formula:

$$R=E*I$$

Where E is the modulus of elasticity for the tubular structural member and I represents the cross section moment of inertia. Both values may be calculated based on the tubular structural member's geometry and composition. The I for a tube is readily determined. Similarly, the resistance may be determined by simply measuring the tubular structural member's resistance. By changing either, or both, the modulus of elasticity or the cross section moment of inertia, the resistance of the tubular structural member can be changed. Different embodiments of the tubular structural member can allow for either the modulus or the moment of inertia to be changed, so as to vary the resistance available to the user. For example, embodiments employing a machined tubular structural member are changing the cross section moment of inertia. Other embodiments may use different materials to physically change the tubular structural member's modulus of elasticity.

Figure 8A:
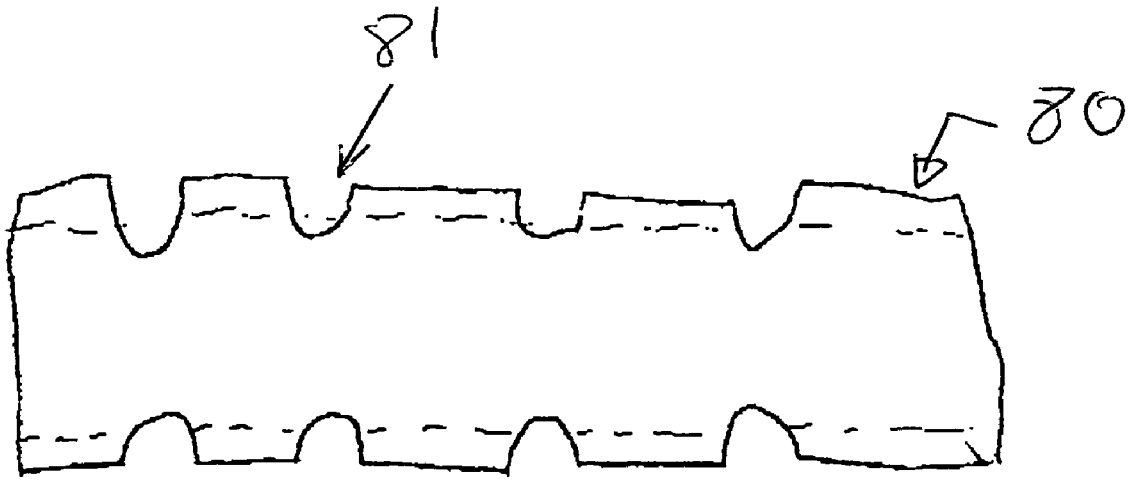
FIG. 8*a* and FIG. 8*b* depict a tubular structural member having lateral slots.
Figure 8B:
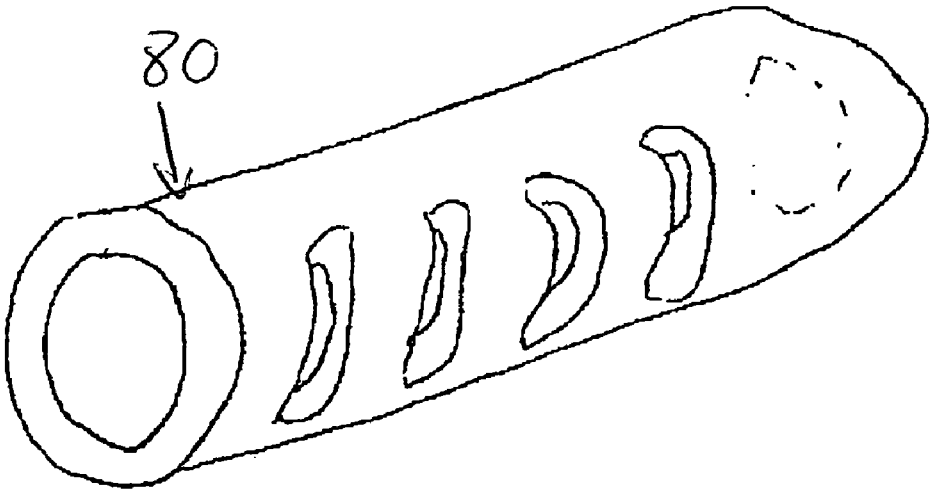

FIG. 8 demonstrate one embodiment of the tubular structural member. FIGS. 8*a* and 8*b* show a grooved tubular structural member 80 where the tube retains its overall circular shape but has material removed along its length. The removal of the tube's material creates grooves or other indentations 81. There are grooves etched along two opposite sides along its length. These grooves may go through the tube wall, if desired.

Figure 5:
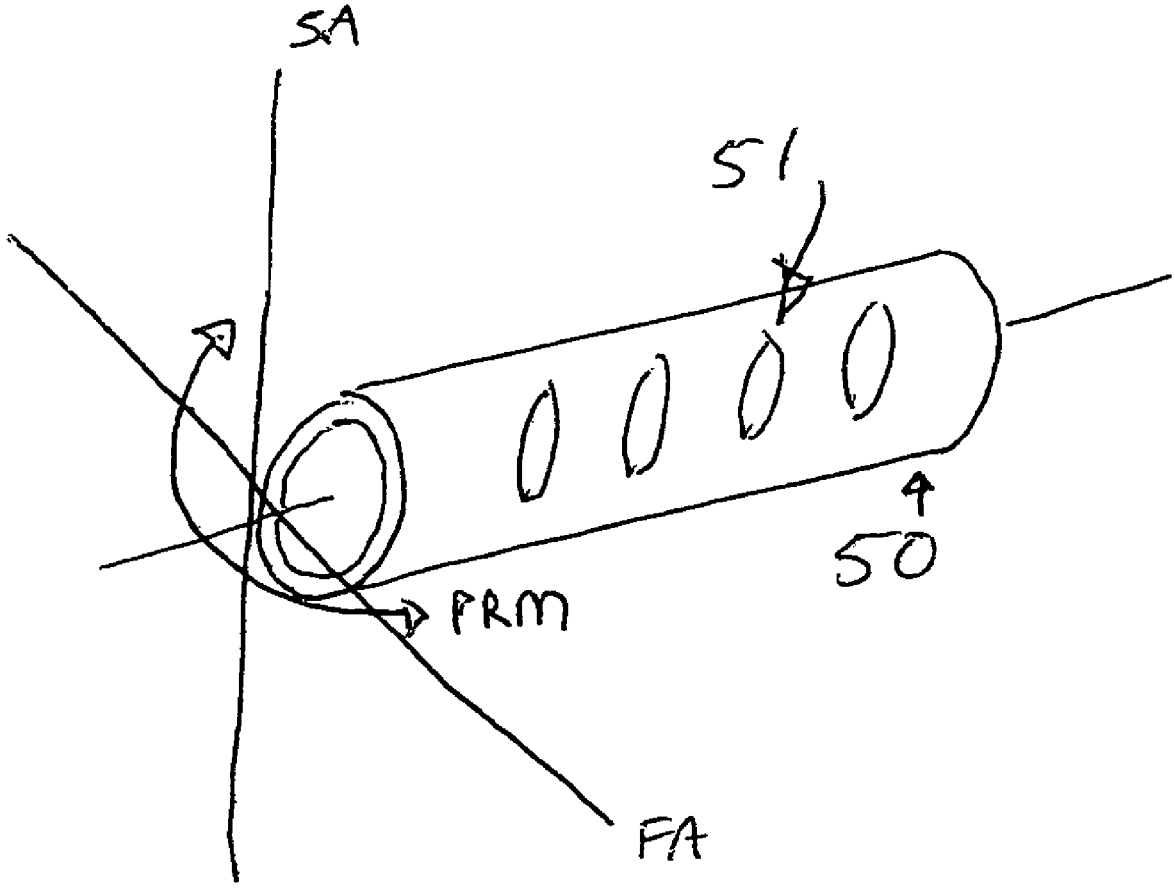
FIG. 5 depicts the axes of motion of an etched tubular structural member.

As shown in FIG. 5, the effect of these grooves 51 gives the grooved tubular structural member 50 a stiff axis and a flexural axis. The flexural axis is created by removing the material and thus changing its cross sectional moment of inertia. The grooved tubular structural member 50 will prefer to bend along the PRM, about the SA.

In one embodiment, an etched tubular structural member forms a jacket to be placed over the frame of a device. The tubular structural member will be placed over the area of the device where it is desired to affect its flexing resistance. This area is the reinforcement area. The etched tubular structural member comprises an Outer Tubular Flex Adjustment Member for the device on which it's used. When the Outer Tubular Flex Adjustment Member is placed on the device's reinforcement area, the device now has the ability to change its stiffness relative to a certain plane depending on the Outer Tubular Flex Adjustment Member's orientation on that device.

Figure 6:
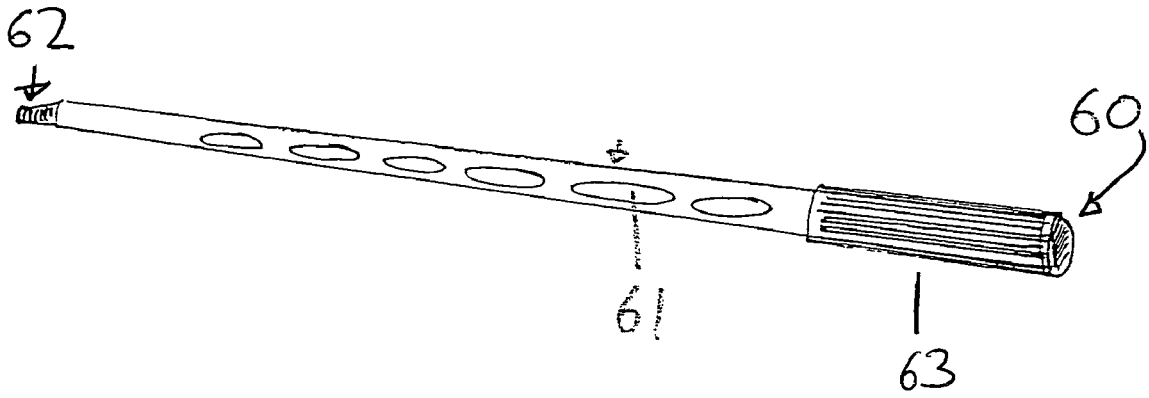
FIG. 6 depicts an etched tubular structural member for a golf club shaft.

FIG. 6 depicts one such embodiment for the jacket, this embodiment being used with a golf club shaft. The Outer Tubular Flex Adjustment Member 60 comprises an etched tubular structural member with grooves 61 removed along its length. Also attached to the Outer Tubular Flex Adjustment Member 60 are a dust boot 62 and a grip 63. The Outer Tubular Flex Adjustment Member 60 will provide variable stiffness to a golf club shaft once attached and orientated for the preferred resistance.

Figure 7:
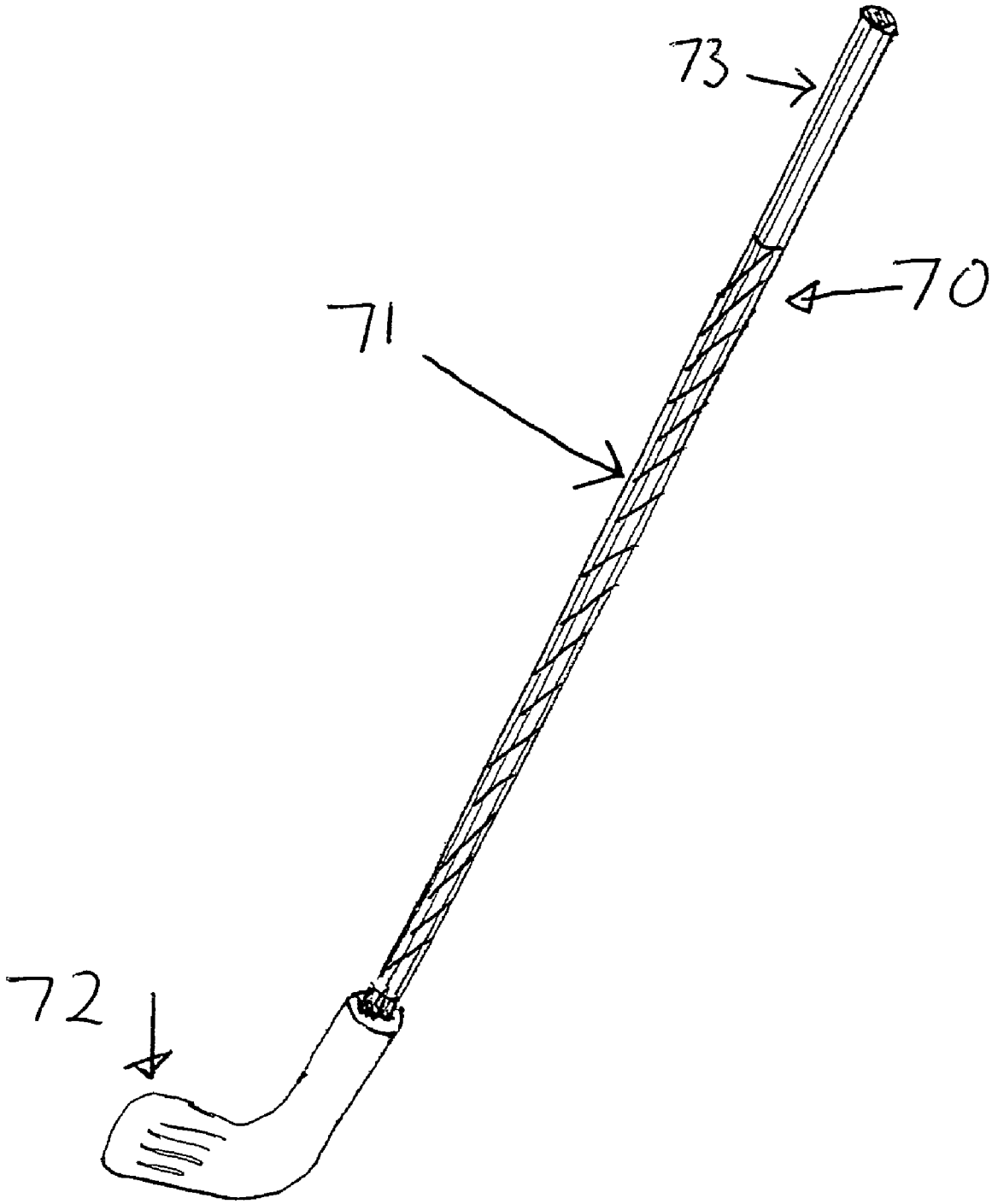
FIG. 7 depicts the construction of a golf club shaft having a reinforcement area.

FIG. 7 shows the golf club frame 70. The golf club frame 70 has a reinforcement area 71 located on its shaft 73 on which the Outer Tubular Flex Adjustment Member will rest. The golf club head 72 is attached to the reinforcement area 71 or shaft 73 to complete the frame.

Figure 9:
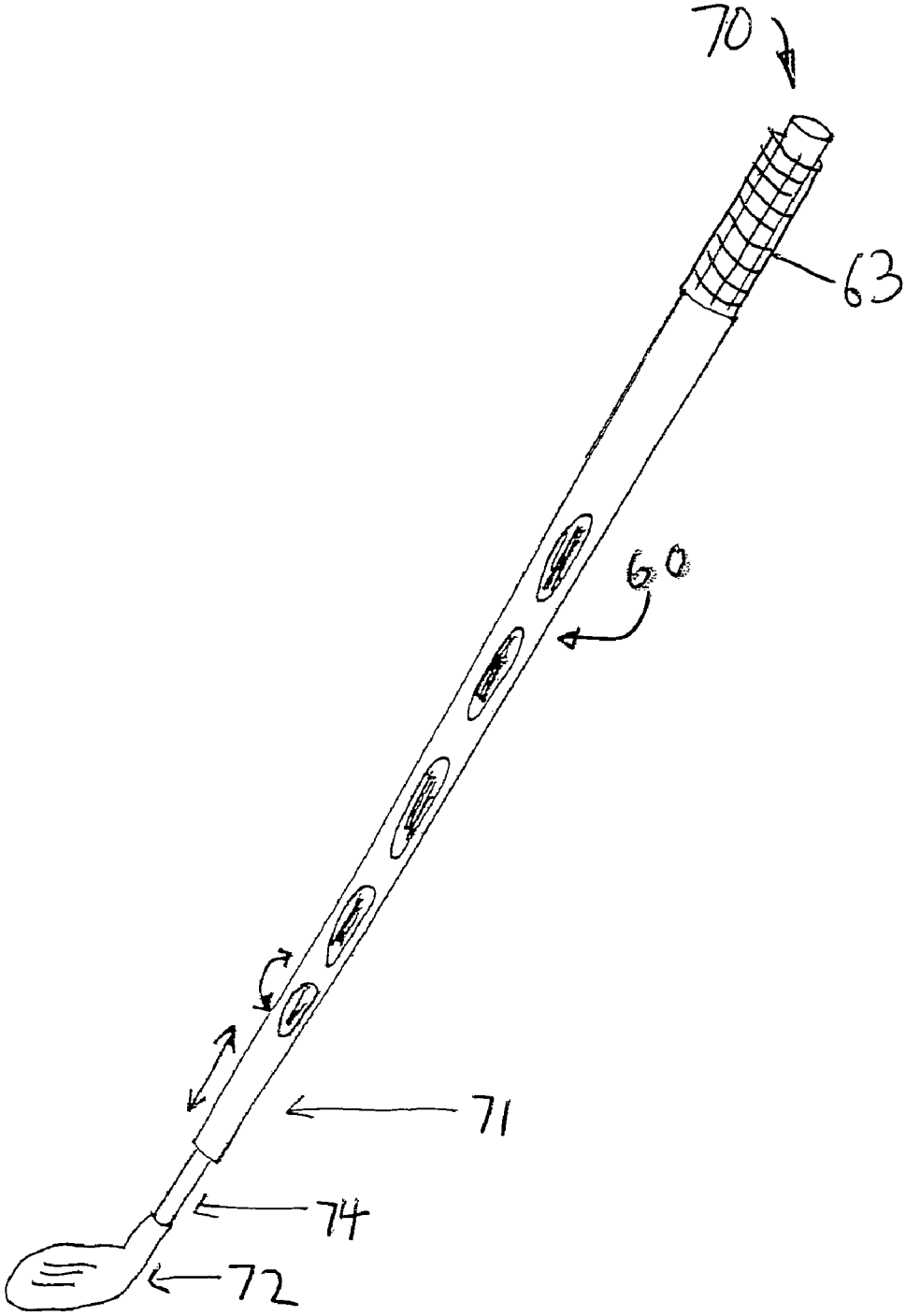
FIG. 9 depicts a golf club shaft and an attached Outer Tubular Flex Adjustment Member.

FIG. 9 shows the golf club frame 70 and the Outer Tubular Flex Adjustment Member 60 joined together. The completed golf club will allow the user to change its resistance based on the relative orientation of the Outer Tubular Flex Adjustment Member 60 to the golf head 72. The dust boot 74 would protect the point at which the Outer Tubular Flex Adjustment Member 60 attaches to the reinforcement area 71 near the golf club head 72. In one such embodiment, the taper of the shaft will fit the taper of the inner diameter of the Outer Tubular Flex Adjustment Member. In another embodiment, the golf club's stiffness will be set at the time of manufacture by simply positioning the Outer Tubular Flex Adjustment Member and securing it to the internal member.

An embodiment for the manufacture of the golf club would have the step of attaching the dust boot to the tip of the Outer Tubular Flex Adjustment Member. The club shaft is inserted onto the Outer Tubular Flex Adjustment Member though the butt or grip. The golf club head will then be attached to the club shaft. The grip is then affixed to the Outer Tubular Flex Adjustment Member. The Outer Tubular Flex Adjustment Member will be longer than the shaft so that it will be pushed toward the tip, allowing it to disengage from its friction fit with the club shaft permitting the user to rotate the Outer Tubular Flex Adjustment Member to its desired flex position.

The user changes the level of golf club stiffness by pushing the Outer Tubular Flex Adjustment Member towards the golf club head, or tip. The Outer Tubular Flex Adjustment Member is rotated to the desired position. FIG. 9 shows this range of motion. The Outer Tubular Flex Adjustment Member is then pulled back away from the head or tip to reestablish contact with the golf club shaft. Contact with the shaft locks the Outer Tubular Flex Adjustment Member into place, either by friction or other means. Using friction of the shaft on the Outer Tubular Flex Adjustment Member reduces the number of parts. The golf club is now ready for use.

We claim:

1. A tubular structural member comprising:

a tube having an internal cavity, a longitudinal axis, a flexural plane, and a stiff plane, the flexural plane and the stiff plane extending radially from the longitudinal axis, the tube having a flexural resistance that is greatest in the stiff plane and least in the flexural plane; and a device having a bending plane and a reinforcement area, the reinforcement area having an outer diameter that matches the inner diameter of the tubular structural member, wherein the tubular structural flexural plane is placed over the reinforcement area and aligned radially on the reinforcement area so as to provide the device with flexural resistance along the bending plane by positioning the stiff plane and flexural plane with respect to the bending plane to provide a desired flexural resistance.

2. The tubular structural member of claim 1, wherein the inner diameter of the internal cavity is tapered along the longitudinal axis; and the outer diameter of the reinforcement area matches the tapered inner diameter of the internal cavity.

3. The tubular structural member of claim 1, further comprising means of attaching and rotating the tubular structural member about its longitudinal axis with respect to the device, so as to change the relative flexural resistance of the device along the bending plane.

4. The tubular structural member of claim 1, wherein the tube has material removed from along the flexural plane.

5. The tubular structural member of claim 1, wherein the tube has material added along the stiff plane.

6. The tubular structural member of claim 1, wherein the tube wall comprises a high flexural resistance material and a low flexural resistance material arranged so that the composite flexural resistance of the tubular structural member is greatest in a direction parallel to the stiff plane.

7. The tubular structural member of claim 1, wherein the tube wall that is shaped so that the tube wall thickness that is greatest in the cross section through the stiff plane and thinner in a cross section through the flexural plane.

* * * * *